US006378868B1

(12) United States Patent
La Bossiere

(10) Patent No.: US 6,378,868 B1
(45) Date of Patent: Apr. 30, 2002

(54) WORD GAME

(76) Inventor: Paul W. La Bossiere, 125 North St., Willimantic, CT (US) 06226

( * ) Notice: Subject to any disclaimer, the term of this patent is extended or adjusted under 35 U.S.C. 154(b) by 0 days.

(21) Appl. No.: 09/827,207

(22) Filed: Apr. 5, 2001

(51) Int. Cl.[7] ..... A63F 3/00
(52) U.S. Cl. ..... 273/272; 273/299
(58) Field of Search ..... 273/299, 272, 273/240; 434/159, 167, 171, 172

(56) References Cited

U.S. PATENT DOCUMENTS

| | | | | |
|---|---|---|---|---|
| 3,053,537 A | | 9/1962 | Moss | 273/137 |
| 3,195,895 A | | 7/1965 | Kropinski | 273/135 |
| 4,014,548 A | | 3/1977 | Trilling | 273/135 D |
| 4,340,231 A | * | 7/1982 | Cammarata | |
| 4,923,199 A | | 5/1990 | Hahn | 273/299 |
| 4,934,711 A | * | 6/1990 | Runstein | |
| 4,955,614 A | * | 9/1990 | Buda | |
| 5,149,103 A | | 9/1992 | Ross | 273/432 |
| 5,374,065 A | | 12/1994 | Motskin | 273/272 |
| 5,769,421 A | * | 6/1998 | Wakefield | |
| 6,116,604 A | * | 9/2000 | Vandelli | |

OTHER PUBLICATIONS

WORDTHIEF™, Rules, Regulations, etc., two pages, 1994.
Rules for playing SCRABBLE, one page, 1948.

* cited by examiner

*Primary Examiner*—William M. Pierce
(74) *Attorney, Agent, or Firm*—Albert W. Hilburger

(57) ABSTRACT

A game in which each player randomly draws playing tiles, either blank or letter displaying, from a receptacle and constructs words with them, positioning them on her personal viewing area, with play transferring from player to player. At the end of her turn, each player enters her score and replenishes her playing tiles. Players can remove ("steal") other players' playing tiles to construct at least one new word by adding at least one additional playing tile at her own personal viewing area. Play continues until the end of the game determined when all of the playing tiles have been removed and when none of the players can any longer construct a word with the playing tiles at the personal viewing areas. A basic score is achieved by placing a value of one on each tile used in a new word plus each tile reused to reveal additional words within that new word.

20 Claims, 4 Drawing Sheets

SAMPLE SCORE SHEET

PLAYER _____

32

| WORD | POINTS | X | TOTAL POINTS | SCORE |
|---|---|---|---|---|
| flag, la, lag | 9 | 1 | 9 | 9 |
| | | | | |
| father, fa, fat, at. | | | | |
| the, he, her | 21 | 1 | 21 | 30 |
| | | | | |
| Bonus | 25 | | 25 | 55 |
| | | | | |
| nightingale, nigh | | | | |
| night, tin, in, gal. | 35 | 3 | 105 | 160 |
| gale, ale | | | | |
| | | | | |
| nightingales, nightingale | | | | |
| nigh, night, tin, in | | | | |
| gal, gale, gales | | | | |
| ale, ales | 56 | 1 | 56 | 216 |
| | | | | |
| Penalties x.q = 20 | | | | |
| 1 wild tile = 20 | 40 | | -40 | 176 |
| | | | | |
| | | | | |

FIG.5

WORD GAME

BACKGROUND OF THE INVENTION

1. Field of the Invention

The present invention relates to games and, more particularly, to games which are played with movable pieces to form words.

Throughout this disclosure, the female gender will be employed for referring to players for sake of simplicity of explanation although it will be understood the players may be of the male gender or may be of mixed genders.

2. Prior Art

Numerous word games have previously been developed for play by groups of individuals. These games, such as Scrabble®, are both educational and informative insofar as they require the players to compose words formed with a limited number of letter tiles and board space. For example, in the Scrabble® game, words are formed using single-letter tiles selectively placed in spaces on a two-dimensional matrix printed on a playing board. Scoring is determined by point values assigned to the letter tiles as well as bonuses assigned to some of the letter spaces, that is, double and triple letter spaces. The point value assigned to a letter depends upon the frequency of use of the letter in the language. For example, an "x " has a higher assigned value than does an "e". While the Scrabble® game has enjoyed substantial commercial success, word formation is relatively simple because each tile contains only one letter. Furthermore, scoring is primarily based on letter usage, rather than on word length.

There are a number of other known word games which are described in the patent literature. For example, U.S. Pat. No. 3,053,537 to Moss discloses a word building game having several different classes or kinds of pieces, some displaying single letters of the alphabet, others displaying equispaced two letters forming word-parts, and still others displaying equispaced three or more letters forming word-parts, which pieces may be juxtaposed in such relation to form words.

U.S. Pat. No. 5,374,065 to Motskin discloses a game according to which a first player places a first plurality of tiles on a grid marked game playing board, then a second player places only a single tile on the board adjacent to the first plurality of tiles and wherein the first and second players continue to build about the first plurality of tiles and the second tile by placing additional pluralities of tiles on the board.

U.S. Pat. No. 4,923,199 to Hahn discloses a word game which utilizes a deck of sixty cards having letters that appear in numbers corresponding to their frequency of use in the English language. Fifteen cards are dealt to each player who must then make as many words as possible from the fifteen letters, using the letters again from word to word. The words are scored based on length with one point being given for each word having three letters and a larger number of points being given for words having a greater number of letters, up to a maximum of fifteen letters for any one word.

U.S. Pat. No. 4,014,548 to Trilling discloses a word game which comprises a number of multiple-letter alphabetic tiles as well as single-letter alphabetic tiles located by a player on successive letter spaces on a printed playing board. Each player has her own playing board having printed thereon a single row of letter spaces. One of the spaces (termed "master space") receives a randomly picked multiple-letter tile (termed "master tile"). A word is formed by the player by adding single-letter tiles to the master-letter tile so as to compose a word. A score point value is assigned to each letter space on the board with the magnitude of the score point value depending on its distance from the master space. The score point value of a word is determined by adding together the point values assigned to the letter spaces corresponding to the starting and ending letters of the word. Score point values may also be assigned to the master tiles.

In the Trilling game, some of the letter spaces are designated as "joker spaces". If a single-letter tile, designated as a "joker", falls on a joker space in a composed word, a bonus value is added to the score point value of the word. Players obtain high scores by formulating long words with a maximum number of joker tiles landing on joker spaces.

It was with knowledge of the availability of the foregoing word games that the present invention has been conceived and is now reduced to practice.

SUMMARY OF THE INVENTION

In a word building game according to the present invention, initially, each player randomly draws playing tiles, each displaying either a letter face or a wild, or blank, face, from a supply source. Initially, she places them in a row for her own private viewing but not being capable of being seen by the other players. Then she constructs a word or words with them, positioning them in her personal viewing area so as to be readable by the other players. Each player records her score for each word based upon the number of tiles in each word plus the number of tiles reused, in reading order, to identify additional words within each of the constructed words. The player notifies the other players when the scoring for each word is completed as a signal that allows the other players, in right to left order from that player, to name any unidentified words and thereby gain extra points for themselves. At the conclusion of the turn, the player replenishes her playing tiles to the predetermined number originally drawn and the play transfers to the next adjoining player. After the completion of the first round, an initial player creates new words from her row, changes already created words in her playing area by adding another letter, and/or surveys the personal viewing areas of the other players to determine if new words can be created from their words by adding at least one new tile already at her viewing area for each stolen word. If so, the player removes the word, adds the necessary tiles and recreates the new word at her viewing area. The player then generally scores such words based upon the number of times those words have been recreated and the number of tiles used in the new word as well the number of tiles used in the words found within that new word. The player continues to create and score as many words as possible from as many players as possible in this manner, each time notifying the other players when the scoring for each word is completed. When unable to create any more words, the player replenishes the used tiles and play transfers to the next adjoining player. Play continues until the end of the game, determined when all of the tiles have been removed from the source of supply and one of the players goes out by using all the remaining tiles in her row, and/or, when none of the players can construct a word with the tiles remaining in their personal viewing areas. After deducting for penalties, the highest score wins.

The present invention, then, provides a word building game for two or more players utilizing a pool of playing tiles each bearing a letter of the alphabet on its face, with several blank tiles, and a scoring sheet for each player.

A primary feature, then, of the present invention is the provision of a novel word game which is challenging to players.

Another object of the present invention is the provision of a word game which encourages the formation of words which contain other words within them by basing score value on the number of times the same letters are reused as well as word length.

Still another feature of the present invention is the provision of a word game which is simple to play and easy to manufacture.

Yet another feature of the present invention is the provision of such a word game which presents a challenge to the intellect of the players.

Still a further feature of the present invention is the provision of such a word game which can be utilized in developing language skills, it being recognized that there exists a continuing need in our society for such language development.

Yet a further feature of the present invention is the provision of such a word game which requires the players to carefully scrutinize the construction of the played words, thereby encouraging spelling skills as well as word recognition skills, a knowledge of definitions being essential to the understanding and acceptance of the played words.

Still another feature of the present invention is the provision of such a word game which may be utilized by teachers and students of English as a Second Language as well as remedial classes.

Another feature of the present invention is the provision of a word game which may also be built into a computer program substituting the screen of a computer as the game and scoring board with rules built into a diskette or cartridge or possibly designed as a video game.

Yet another feature of the present invention is the provision of a word game that has the potential to become the basis for a television program.

A further feature of the present invention is the provision of a word game in which the distribution of letters is selected to roughly mimic the frequency with which these letters appear in words in the English language.

Yet a further feature of the present invention is the provision of a word game that allows for an infinite variety of words involving both chance and skill, the letters being drawn by random chance and requiring the skill to put those letters together into meaningful, acceptable words.

Yet a further feature of the present invention is the provision of a word game with a key feature of affording the players an opportunity to increase their scores by taking the letters of other player's words and reusing them in creative reconstructions of new words and thereby increasing the value in arithmetic progression of the reused letters, the value of the letters increasing each time they are reused.

Still a further feature of the present invention is the provision of a word game in which the materials employed for the tiles is not generally critical unless specifically stated, being made of wood, ceramic, plastic or any other suitable material and in which the current score sheet, while believed to be highly suitable for the present version of the game, may be modified to suit expanded applications of the rules.

Still another feature of the present invention is the provision of a word game in which the letters are not static, remaining on a board, unchanged except by the addition of letters, horizontally or vertically as is the case with the Scrabble® game, but rather may be moved from player to player and, indeed, may be removed from a fellow player and scrambled to make an entirely different word.

Yet another feature of the present invention is the provision of a word game in which blank tiles, so-called "wild tiles", may signify different letters whenever they are reused, the wild tiles being physically removed from player to player to allow for a degree of flexibility not seen in many other games.

Still a further feature of the present invention is the provision of a word game which provides players with the ability to reconstitute the letters into new words, thereby demanding a degree of skill in cognitive restructuring not fully found in other word games.

Yet a further feature of the present invention is the provision of a word game in which the score value of each letter is increased in arithmetic progression each time that particular letter is reused in a new word.

Still another feature of the present invention is the provision of a word game in which players identify words existing within the letter order (left to right) of formed words and, thereby, increase their scores and in which other players may reap additional scores for themselves by identifying words within words which other players may have missed.

Still a further feature of the present invention is the provision of a word game presenting a challenge to the players to construct words from which they may extract the highest possible score but which will also be difficult for other players to steal.

Yet a further feature of the present invention is the provision of a word game in which players may develop strategies to determine which letters or wild tiles to use and when to use them in order to obtain a higher score and also to "go out" when desired.

Yet another feature of the present invention is the provision of a word game in which the First Player is selected by forming the first or longest word in the first round.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and together with the description, serve to explain the principles of the invention in general terms. Like numerals refer to like parts throughout the disclosure.

BRIEF DESCRIPTION OF THE DRAWINGS

The foregoing aspects and other features of the present invention are explained in the following description, taken in connection with the accompanying drawings, wherein:

FIG. 5 is a sample score sheet presenting an example of scoring by a player of the word game of the invention.

DETAILED DESCRIPTION OF THE PREFERRED EMBODIMENT

Figure 1:
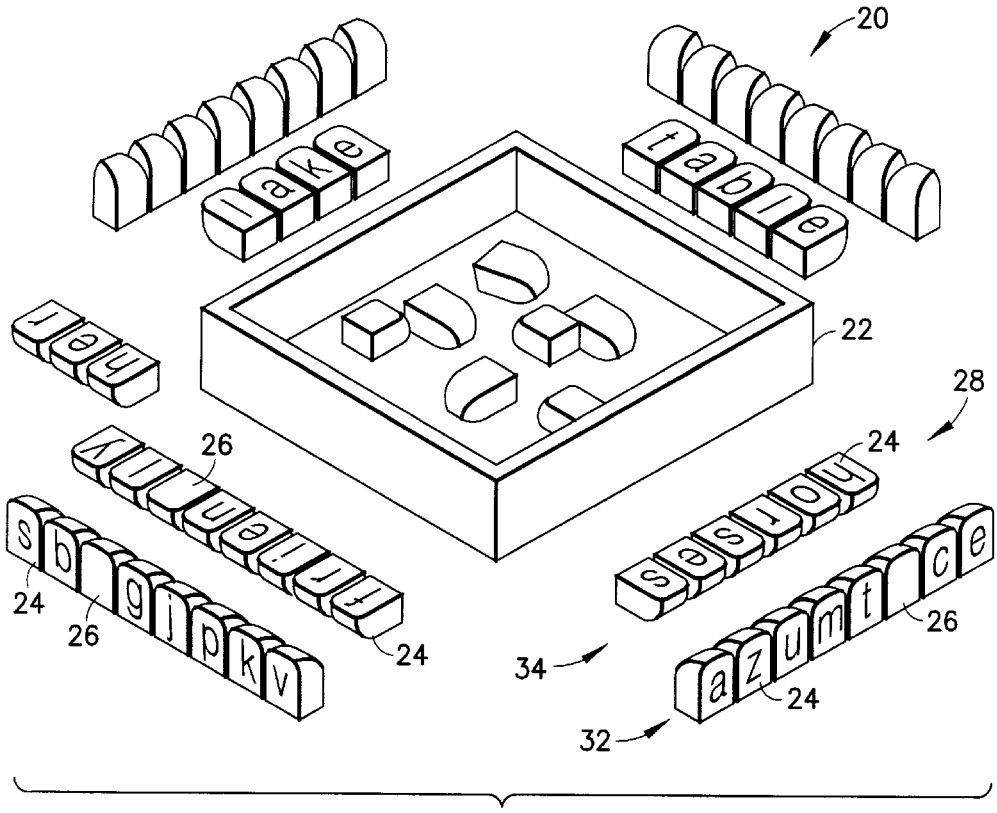
FIG. 1 is a diagrammatic perspective view of a game playing area embodying the present invention.

Referring to FIG. 1, there is shown a perspective view of a game playing area 20 for a word game of the present invention. The game playing area 20 is arbitrarily set up for four players and incorporates features of the present invention. Although the present invention will be described with reference to the single embodiment shown in the drawings, it should be understood that the present invention can be embodied in many alternate forms of embodiments. In addition, any suitable size, shape or type of elements or materials could generally be used.

Figure 2:
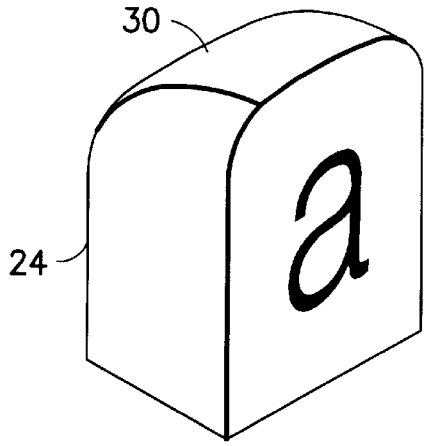
FIG. 2 is a perspective view of a playing tile for use in the game of the invention, this playing tile being a letter tile bearing a letter of the alphabet on a face thereof.
Figure 3:
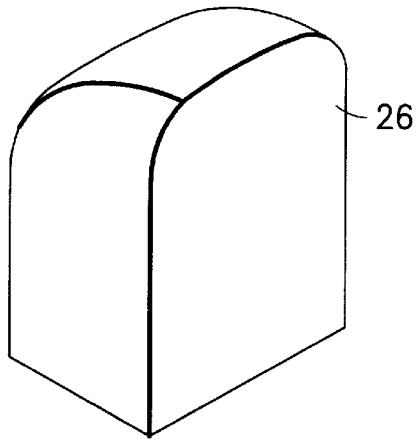
FIG. 3 is a perspective view of another playing tile for use in the game of the invention, this playing tile being a wild tile bearing no letter of the alphabet on any of its faces.

The physical requirements of the game constitute a receptacle 22 (FIG. 1) for one plurality of playing tiles 24 (FIG. 2), each bearing a letter of the alphabet on a face thereof and referred to as "letter tiles", and for another plurality of playing tiles 26 (FIG. 3), referred to as "wild tiles" and being blank, that is, bearing no letter of the alphabet on any of its faces. Each player operates from a personal viewing area 28 at which are located her share of the letter tiles 24 and wild tiles 26. The letter tiles 24 are preferably formed with a rounded top side 30 to assure that a playing tile will be caused to tip over if placed upside down on the personal viewing area 28. In this manner, a player cannot position a playing tile so it is read incorrectly and confuse a "b" for a "p" or an "n" for a "u". Although the wild tiles are devoid of indicia, they would be similarly formed for consistency. It may be desirable to provide wild tiles whose blank face has a suitable composition enabling a player, if she chooses, to write on it with an erasable marker the letter she chooses that wild tile to signify.

The play of the game will now be described with the aid of headings for relating the successive features and elements of the game.

Object of the Game

The object of the game is for each player to create her own words and also to steal as many words as she can from all the other players in order to increase her score.

Game Directions and Rules

Figure 4:
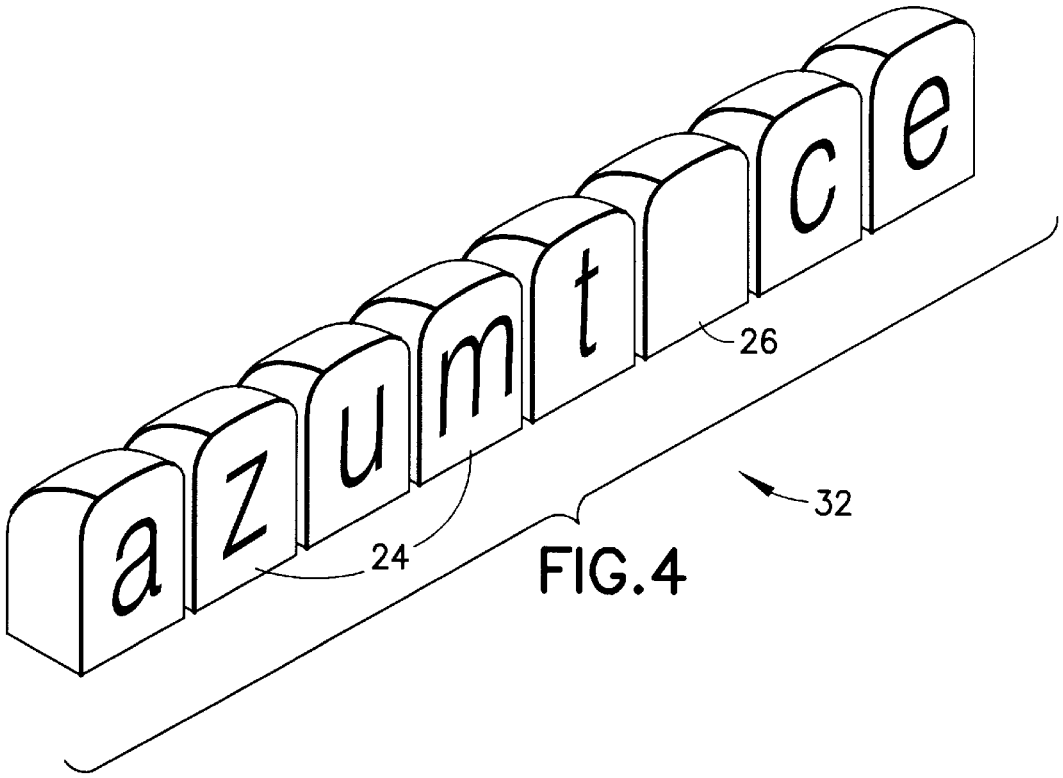
FIG. 4 is a perspective view illustrating a playing tile placed in a personal viewing area.
Figure 6:
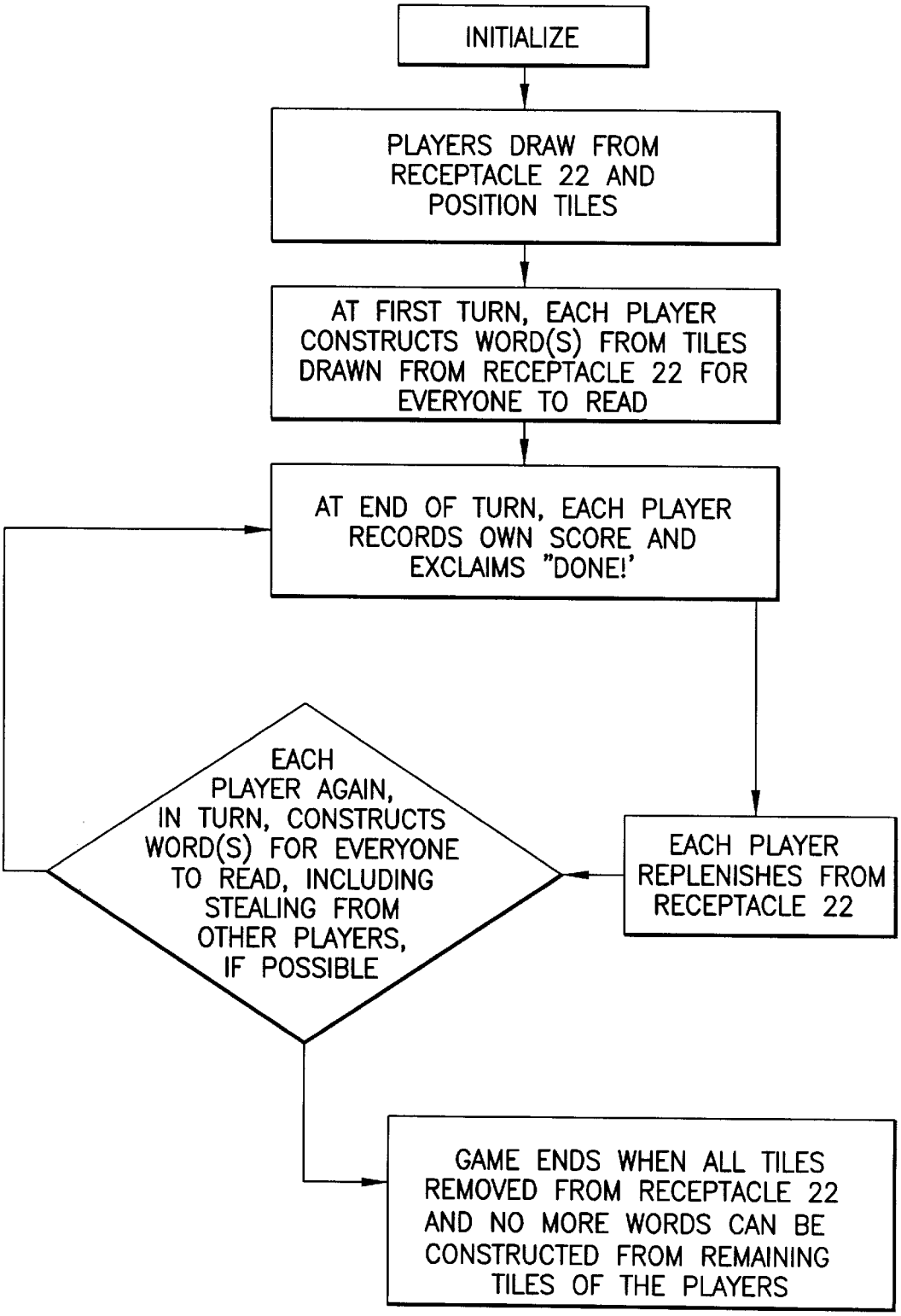
FIG. 6 is a flow chart showing a method of playing a word building game embodying the present invention.

The game is played directly from the receptacle 22 which may be the box in which the game is originally contained or any other type of container from which it is convenient for the players to extract the tiles. The receptacle 22 is positioned at a location convenient to the reach of all of the players. All letter tiles 24 and wild tiles 26 are placed face down in the receptacle 22 or scrambled in a container from which they cannot be seen so the players are uninformed of the letter of the alphabet on the letter tiles or whether a tile is in fact a wild tile. The players must first decide how many letter tiles are to be drawn by each and every player at each turn. Eight to twelve letters are recommended. It will be appreciated that the more letters in each player's row in her personal viewing area 28, the shorter will be the play of the game. They must also decide how many wild tiles to use, as will be discussed below. Having made these decisions, the players randomly draw sufficient letters from the receptacle to bring their tiles to the agreed total. The letter tiles and the wild tiles are placed in a row 32 (FIGS. 1 and 4) in front of each player with the curved side up and positioned so that the other players cannot read them.

Wild Tiles

There may be ten tiles, for example, with no letters on them. Such tiles are referred to as wild tiles 26. A player using one of these wild tiles may designate it as any letter each time it is used. Such a tile may be named an "a" in one word but may be renamed as a "w" by another player or, in another turn, by the same player. If the wild tile is constructed with an erasable face, the player may, if she chooses, write the letter she designates the tile to be using an erasable marker. Players may agree before beginning the game to use four, eight, or ten wild tiles, for example, or even to eliminate them all together.

Once a wild tile 26 has been played, it is subject to being stolen. If a player has the letter which the wild tile represents and that player needs another letter which she does not have, the player, on her turn only, may steal the wild tile by replacing it with the designated letter and then use the wild tile as a different letter to create or steal another word. The stolen wild tile must be used immediately.

To Begin Play

Each player constructs a word or words with the letter tiles 24 or wild tiles 26, placing them flat up facing the other players, as indicated by reference numeral 34, so that all may read them. The first player to put out a word is designated The First Player. In the event of a tie, the player with the longest word becomes The First Player.

Acceptable Words

Words found in a standard adult level dictionary, which is selected before the game begins or words not found in that particular dictionary upon which all players agree as to their validity, are considered to be acceptable words. Acceptable words include:

- foreign words, slang, and archaic words that have become a part of the present day English language;
- unhyphenated, compound words; and
- words that may not be proper nouns in one usage but in another use may be proper. Example: An evasive action, dodge; or a car, Dodge. The player must clarify the non-proper usage of the word.

Any unchallenged word becomes acceptable and earns points even if it is misspelled or is not a word.

Unacceptable Words

Unacceptable words are:

- Words that must be capitalized, i.e. proper nouns; Examples: Ann, Paris;
- words requiring punctuation; Examples: I'm, Mrs.;
- abbreviations not requiring punctuation or acronyms: Examples: Ms, NASA;
- one letter words; Examples: I and a; and
- any misspelled or challenged words proven or accepted to be wrong.

Challenges

Once a complete word is put down it cannot be changed in that turn and its acceptability may be challenged. Any player, in right to left order of turns from the present player, may challenge a word as to its spelling or its meaning as spelled, but only at the time it is put down. All challenges are settled by a standard adult dictionary or by general agreement. If a word is successfully challenged, the letters must be returned to the players involved and the turn ends for the challenged player. If the challenger is wrong, the challenger loses the next turn.

Scoring

The players record their own scores on a score sheet 32 (FIG. 5) as follows:

Each player's new word is written on the score sheet under the heading "WORD" on a separate line followed by a comma. Then any words that that player can see within that word, in left to right order, as normally read, are also written on the same or succeeding lines, each followed by a comma. The player then counts one point for each letter of all the words. As a result, some of the letters are counted more than once. These points are placed under the "POINTS" column.

Example: FATHER, six letters, six points. But within that word can be found, in reading deft to right) order: FA, two points; FAT, three points; AT, two points; THE, three points; HE, two points; and HER, three points. Adding all of these points produces a total of twenty-one points. Twenty-one (21) is placed under the "POINTS" column.

Letters forming a word within a word must be contiguous, that is, they must be side by side and follow each other from left to right. They cannot be scrambled.

The first time a word is created, a one (1) is placed under the "X" column and the points are multiplied by 1 and placed under the "TOTAL POINTS" column, then the total points are placed under the "SCORE" column. With each additional word, the accumulated, or total, points are added to the "SCORE" column to give the player a running total score.

Bonuses

Any player using all letter tiles in one turn on one or more words earns a bonus, for example, of twenty-five (25) points. The word "Bonus" is placed under the "WORD" column and 25 is placed under the "POINTS" column and added to the "SCORE" column.

"Done!"

As each player finishes scoring a word and places the points in the "TOTAL POINTS" column, that player must say, "DONE!", which is the signal that allows the other players, in right to left order from that player, to name any unidentified word within the recorded word. Only such players successfully discovering additional words may write those words on their score sheets at the same value as the word within which they were found. The original player loses the opportunity to record such words and thus loses points that could have been gained.

A player failing to say "DONE!" upon completion of scoring a word loses the remainder of her turn or, if at the end of a turn, the next turn.

Scoring (continued)

As the players complete scoring the words in the first round, they each replenish from the receptacle 22 the letter tiles they have used so that they are always playing with the previously agreed upon total amount of letters in their row.

After the First Round

After all players have had their turns, whether or not they were able to create or retain a word, the first round is complete. It is at this point that the game really begins. The First Player now looks over all created words and, as well as making new words from her own row or changing her own previously created words by adding one or more letters, attempts to steal words from any of the other players. If the First Player can add at least one letter to another player's word or words, the letters are removed by the First Player and placed in front of her and the new word formed facing the other players. The letters may be scrambled to make a completely different word. If the new word is challenged and found not to be acceptable, the First Player must return all letters and that ends the First Player's turn. If the word is accepted, it is written on the score sheet under "WORD", followed by a comma and any words that the First Player can find within that word are also recorded, each followed by a comma. A two (2) is placed under the "X" column to show that the points in this word are doubled because it has been stolen and the letters are being used for a second time. The First Player must remember to say, "DONE!", after scoring the new word. The First Player steals as many words, creates additional new words, scores all words and then replenishes the used letter tiles to bring the row up to the agreed total.

The next player to the left now has the turn and repeats the procedure of the First Player; making new words, stealing, scoring points and saying, "Done", so that the other players may identify missed words and gain extra points for themselves.

Words may be stolen again and again. Each time a word is stolen, a higher numeral is placed under the "X" column denoting the number of times the letters are being reused. A "2" shows that the letters are being used for a second time and the points are doubled. A "3" shows that they are tripled, and so forth. If two words are stolen, each having different values, the higher value prevails when combined into one word. Example: GAL is stolen and made into GALE. It now has a value of "2". NIGHT is created by another player and has a value of "1". A fourth player now steals both words, combines them by adding IN, into NIGHTINGALE. That word now has a triple point value and a "3" is placed in the "X" column. It is counted to have 35 points, that is, NIGHTINGALE, NIGH, NIGHT, TIN, IN, GAL, GALE, and ALE. These are tripled for a total of 105 points.

When combining two or more words into one word, there must be at least one additional tile for each word comprising the new word. Thus, the letters in one word cannot simply be switched around to create a new word without adding at least one new letter.

Whenever a player changes by adding to her own words, regardless of their present value, that player may only score the change with a value of "1". Example: NIGHTINGALES from the above example, if produced by the same player who created it would generate only 56 points, that is, NIGHTINGALES, NIGHTINGALE, NIGH, NIGHT, TIN, IN, GAL, GALE, GALES, ALE, and ALES. If another player stole the word by simply adding an "s", she would score 224 points (that is, 56×4).

Before a word is stolen, a player is not required to reveal its value until the new word is being scored.

If a player is unable to make her own words or to steal any words, the turn transfers to the next player. The game continues with each player taking turns from right to left, until all letter tiles have been removed from the receptacle 22.

Length of Game

The length of the game may be regulated in any one or a combination of, three ways. The more players, the more letters per player, the more wild tiles 26 used, the shorter the game. Players may agree at the beginning of the game, not only on the number of tiles in each player's personal viewing area 28, but also, if they wish to reduce the number of or even eliminate the wild tiles.

End of Game

Near the end of the game, a point will be reached in which a player will not be able to fully replenish her personal row due to the lack of letter tiles. That player takes all the remaining letters and proceeds to complete the turn. The other players continue to play without being able to add new letters to their personal rows but put down whatever letters they can to make new words or steal other words. No BONUS points may be earned once a player does not have a full row.

The game then ends with the first player to go out using all of her remaining tiles, or in the event no one is able to go out, when all players have put down all the letters they can in their turns. There is a penalty against each player for each unplayed letter tile, for example, of ten points and each unplayed wild tile, for example, of twenty points. The player with the highest score wins.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A method of playing a word building game for a plurality of players utilizing a score sheet for each of the players comprising the steps of:

(a) providing a source of a plurality of playing tiles including a major grouping of the playing tiles bearing a letter indicia in the form of a letter of the alphabet on a face thereof and a minor grouping of the playing tiles bearing no letter of the alphabet on a face thereof;

(b) each player randomly drawing a predetermined number of chosen playing tiles from the source of playing tiles and placing them in a row on her personal viewing area but initially out of view of the other players;

(c) after step (b), each player constructing a word or words with the playing tiles, positioning them so as to be readable by the other players;

(d) designating the player who first constructs a word according to step (c) as the First Player, that is, the player to initiate continued play of the game;

(e) each player recording her score for each constructed word on her score sheet and notifying the other players after each word is constructed that such scoring is complete and her turn ending when all possibilities for constructing a new word have been exhausted, with play first transferring to the player adjoining the First Player, then to the player adjoining each subsequent player;

(f) at the end of her turn, each player replenishing her playing tiles to the predetermined number drawn in step (b) from the source of playing tiles at the conclusion of her turn;

(g) after completing a first round during which each of the players has taken a turn, the First Player creating new words from her row, changing already created words on her personal viewing area, surveying the personal viewing areas of all of the other players and, if possible, removing from the personal viewing areas of the other players playing tiles and constructing at least one new word by adding to the removed playing tiles at least one additional playing tile already at her own personal viewing area, repeating this process with as many words and as many players as possible and then with play again transferring to the player adjoining the First Player;

(h) each subsequent player similarly creating new words from her row, changing already created words on her personal viewing area, surveying the personal viewing areas of all of the other players and, if possible, removing from the personal viewing area of the other players playing tiles and constructing at least one word by adding to the removed playing tiles at least one additional playing tile already at her own personal viewing area, with play continuing to transfer to the next adjoining player; and (i) continuing to perform steps (c), (e), (f), and (h) until the end of the game determined when all of the playing tiles have been removed from the source of playing tiles and when one player then goes out by using the remaining tiles on her personal viewing area and/or when none of the players can any longer construct a word with the playing tiles at the personal viewing areas.

2. A method of playing a word building game as set forth in claim 1 wherein in step (e), play from one player to the next proceeds from right to left.

3. A method of playing a word building game as set forth in claim 1 wherein after step (c) and until the conclusion of play of the game, the personal viewing areas of all of the players are always visible to all the players.

4. A method of playing a word building game as set forth in claim 1 including the step of:

(j) providing a source of a plurality of wild playing tiles, each playing tile bearing no letter indicia on a face thereof; and (k) the players using the wild playing tiles to designate a letter of the alphabet of her own personal choice in each instance in which a wild playing tile is used to construct a word according to step (c).

5. A method of playing a word building game as set forth in claim 4 wherein step (k) includes the step of:

(l) the players using the wild playing tiles to designate different letters of the alphabet of her own personal choice in each subsequent instance in which the wild playing tiles are used to construct subsequent words according to step (c).

6. A method of playing a word building game as set forth in claim 1 including the step of:

(j) in the event that step (d) results in a tie between two players, designating the player who constructs the longest word with the playing tiles as the First Player.

7. A method of playing a word building game as set forth in claim 1 including the step, before play of the game commences, of:

(j) establishing a definition of acceptable words; and (k) establishing a definition of unacceptable words.

8. A method of playing a word building game as set forth in claim 1 including the step of:

(j) challenging by another player of a word constructed by a player, in left to right order, during her turn and at the time it is constructed;

(k) settling a challenge by referring to a standard adult dictionary or by general agreement of the players; and (l) depriving the challenging player of her next turn in the event her challenge is unsuccessful.

9. A method of playing a word building game as set forth in claim 8 including the step of:

(m) returning successfully challenged words and letter tiles to their former positions.

10. A method of playing a word building game as set forth in claim 1 wherein each playing tile constructing a word has a value of one point; and wherein for scoring each word on a player's personal viewing area, each playing tile is counted within each word identified in left to right order, some of the playing tiles possibly being counted more than once.

11. A method of playing a word building game as set forth in claim 10 including the step of:

(j) multiplying the score for a word constructed from playing tiles of another player's personal viewing area generally by the number of times those playing tiles have been used.

12. A method of playing a word building game as set forth in claim 11 wherein whenever a player recreates words already at her personal viewing area, each tile only has a value of one regardless of how many times a tile has previously been used.

13. A method of playing a word building game as set forth in claim 10 including the step of:

(j) rewarding a player who, in one turn, constructs one or more words using all of the playing tiles at her personal viewing area.

14. A method of playing a word building game as set forth in claim 1 including the step of:

(j) scrambling playing tiles to construct a new word from a previously existing word while adding at least one additional playing tile to the playing tiles of the previously existing word.

15. A method of playing a word building game as set forth in claim 1 including the step of:

(j) penalizing each player for each unplayed playing tile remaining on her personal viewing area at the end of the game.

16. A method of playing a word building game as set forth in claim 4 including the step of:

(k) penalizing each player for each unplayed wild playing tile remaining on her personal viewing area at the end of the game.

17. A method of playing a word building game as set forth in claim 1 including the step of:

(j) penalizing a player for failing to notify the other players that the scoring of a word is completed by depriving her of the remainder of her turn or if her turn has ended by depriving her of her next turn.

18. A method of playing a word building game as set forth in claim 4 including the step of:

(l) providing the wild tiles with erasable surface on which players may write their chosen letters.

19. A method of playing a word building game as set forth in claim 5 including the step of:

(l) allowing a player, during her turn, to steal a wild tile from another player and designate it as a different letter to construct another word.

20. A method of playing a word building game as set forth in claim 1 including the step of:

(j) combining one or more words into one longer word provided a player adds one tile for each word used to make the new word.

* * * * *